US007137155B2

(12) United States Patent
Sugrañes Arimany

(10) Patent No.: US 7,137,155 B2
(45) Date of Patent: Nov. 21, 2006

(54) SET OF PARTS FOR BUILDING THE UPPER EDGE AND CHANNEL IN OVERFLOW SWIMMING POOLS

(75) Inventor: Marcelino Sugrañes Arimany, Barcelona (ES)

(73) Assignee: Ceramica Sugranes S.A., Barcelona (ES)

( * ) Notice: Subject to any disclaimer, the term of this patent is extended or adjusted under 35 U.S.C. 154(b) by 79 days.

(21) Appl. No.: 10/793,938

(22) Filed: Mar. 8, 2004

(65) Prior Publication Data

US 2005/0076429 A1 Apr. 14, 2005

(30) Foreign Application Priority Data

Oct. 10, 2003 (ES) ..... 200302354

(51) Int. Cl.
*E04H 4/00* (2006.01)

(52) U.S. Cl. ..... 4/506; 4/510; 4/512; 4/513; 52/169.5

(58) Field of Classification Search ..... 4/506–513; 52/169.4, 169.5
See application file for complete search history.

(56) References Cited

U.S. PATENT DOCUMENTS 1,461,026 A * 7/1923 Booraem ..... 4/511
1,797,397 A * 3/1931 Booraem et al. ..... 4/511
3,271,913 A * 9/1966 Fields ..... 52/169.5
3,490,081 A * 1/1970 Ogden ..... 4/510
3,824,634 A * 7/1974 Lindqvist ..... 4/510
3,864,887 A * 2/1975 Arens ..... 4/506
3,945,061 A * 3/1976 Whitten, Jr. ..... 4/510
3,975,477 A * 8/1976 Molitor ..... 52/169.1
4,007,566 A * 2/1977 Molitor ..... 4/510
5,279,002 A * 1/1994 Ellis et al. ..... 4/510
5,930,850 A * 8/1999 Baker ..... 4/507
6,023,793 A * 2/2000 Baker ..... 4/510
6,477,722 B1 * 11/2002 Busatta ..... 4/507

FOREIGN PATENT DOCUMENTS

DE 4328305 A1 * 3/1994
FR 2552806 A1 * 4/1985

* cited by examiner

*Primary Examiner*—Khoa D. Huynh
(74) *Attorney, Agent, or Firm*—Pravel Intellectual Property Law, PC; James W. Pravel

(57) ABSTRACT

A set of parts having a "U" shaped channel (11) and a side prolongation (12) are used to form the upper edge and channel in an overflow type swimming pool. The set of parts can include straight parts (1*a*), corner parts (1*b*), drainage parts (1*c*), fitted steps, lane divider anchors, and curved edges. The upper surface of the prolongation slants toward the edge of the swimming pool at an angle of approximately 1 to 15 degrees and forms a base to place tiles to finish the appearance of the swimming pool. The parts can be constructed of ceramic, cement, stoneware, baked clay or other polymer.

12 Claims, 6 Drawing Sheets

SET OF PARTS FOR BUILDING THE UPPER EDGE AND CHANNEL IN OVERFLOW SWIMMING POOLS

FIELD OF THE INVENTION

This invention refers to a set of parts for building the upper edge and channel in overflow swimming pools, in one single operation.

BACKGROUND

Around overflow swimming pools a channel is built at water level or below. There are different types of overflow pools, the main ones are known under the trade names of the Finnish System and the Zurich System, the main difference being the difference in levels between the water and the channel.

To build this edging and channel in overflow pools, a system of two successive casings is often required, which owing to its particular design, is extremely complicated, because any minor deviations that usually occur to a greater or lesser extent, make it impossible to then place the ceramic parts properly or for the pool to overflow correctly.

There is a variant to the Zurich system on the market, trading under the name of Wiesbaden, which attempts to solve these problems with a ceramic part. This part is used as edging, channel and outer surface at the same time, but because it is made in ceramic, it is very expensive. Also, it must be of a very small size and it can only be applied in cases where there is limited space. These parts cannot be used for the Finnish system as they cannot provide the so-called "beach," which is the submerged part of the swimming pool edge between the channel and the inside vertical wall.

Correcting these deviations of the edging/channel later on means significant additional labor costs, as part of the cement has to be chipped, or the inadmissible gaps have to be filled, or what is worse, the different angles needed on the edge near the channel have to be adjusted. This is the situation in the most popular of all the systems: the Finnish system.

SUMMARY OF THE INVENTION

To solve these problems, a set of parts has been designed, that enables building the edging and the channel of the overflow swimming pool in one single operation that is both simple and safe. This set of parts includes straight parts, corner parts, drainage parts, parts for the location of fitted steps, parts to anchor lane dividers, and parts for curved edges. They all have a "U" shaped section that forms the channel itself, the fitting for the grille, and a side prolongation that forms the edge of the pool. The upper surface of this part is used as a base to place the ceramic or stoneware parts that finish the edge of the swimming pool at a convenient level.

The parts that comprise the invention form the edge of the pool and the channel at the same time. These component parts can be manufactured in ceramic, cement, stoneware, baked clay, plastic or another material similar to any of the above.

The side prolongation that forms the edge of the pool and is used as a base to place the tiles that finish the edge of the pool, has been designed so that it can have a hollow configuration, in order for the base to be coplanar with the "U" configuration, so that parts can be placed on a flat surface, as if they were flat tiles, and the upper surface is horizontal, or slanted in the opposite direction of the "U" configuration from which it projects.

BRIEF DESCRIPTION OF THE DRAWINGS

FIGS. 5*a* and 5*b* also show the substantially coplanar lower surface (22) of the "U" configuration (11) and the side prolongation (12).

DETAILED DESCRIPTION OF THE INVENTION

Straight parts (1*a*) have a "U" configuration (11) in section and a hollow side prolongation (12).

Figure 5A:
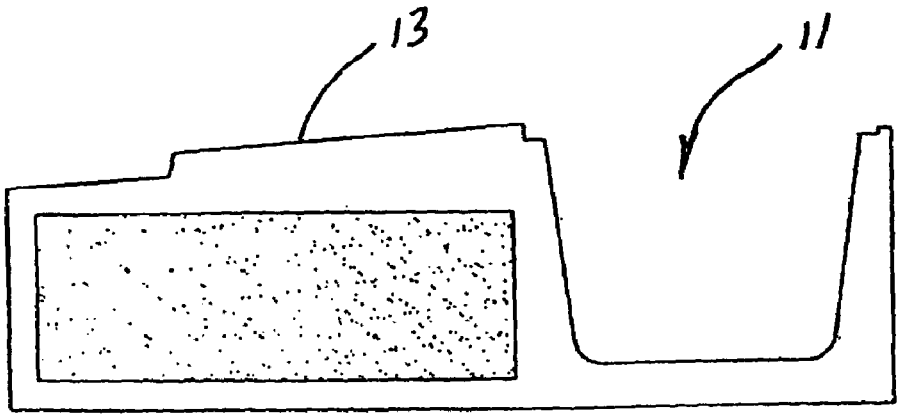
FIG. 5*a* shows a side view of a straight part having a sloping angle needed to build a variant of the Finnish system, or another similar system.
Figure 5B:
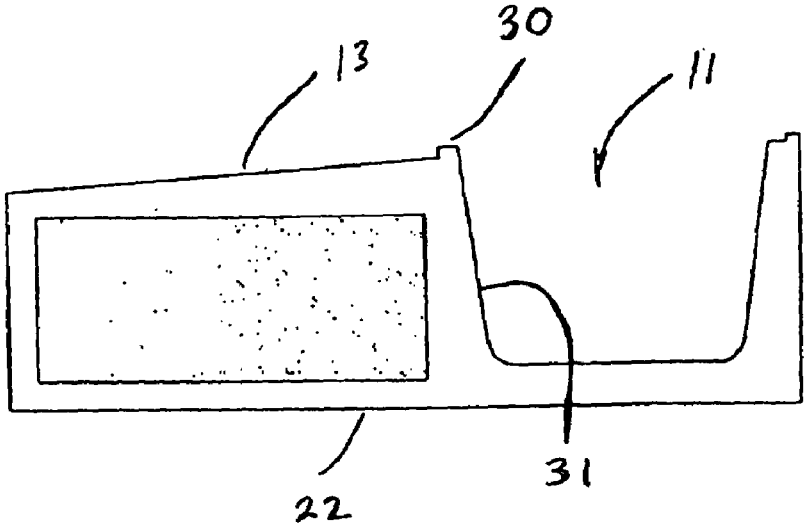
FIG. 5*b* shows a side view of a straight part having a sloping angle needed to build another variant of the Finnish system, or another similar system.
Figure 6:
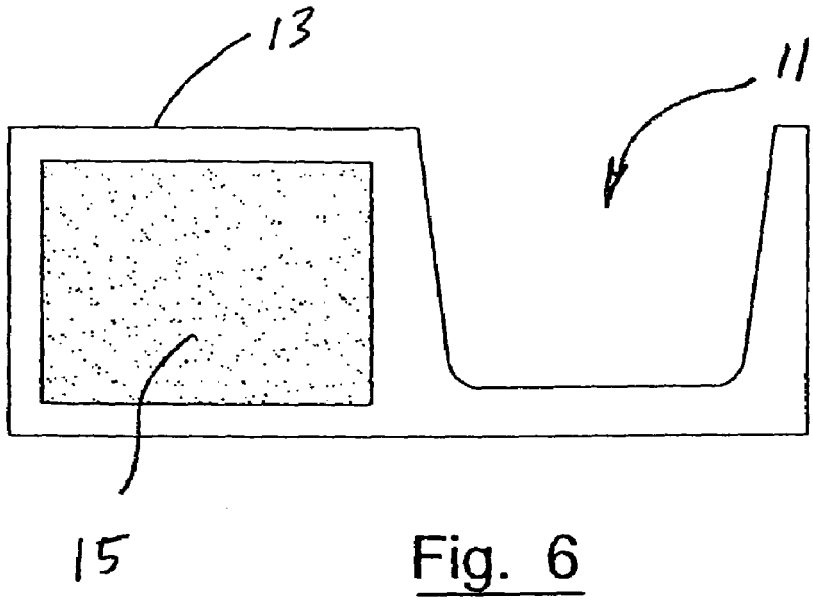
FIG. 6 shows a straight part, the upper surface of which will have a sloping angle equal to zero, and will be used to build the Zurich system, and also the Finnish system under certain conditions.

The upper edge of the swimming pool is built by placing several straight parts (1*a*) adjacently. The "U" configuration (11) forms the channel, while the side prolongation (12) forms the edge of the swimming pool. The "U" shape channel defines an inner wall (31) and an outer wall (32), The upper surface (13) of the side prolongation (12) can slant downwards and be more or less terraced (FIGS. 5*a*, 5*b*) depending on the overall angle of 7 or 8 degrees, or it can be horizontal (FIG. 6), forming in all cases a suitable surface to place tiles (2) that finish the edge of the swimming pool. As shown in FIG. 5*b*, for example, a terraced region (30) is formed on the first end of the upper surface (13) that is adjacent to the inner wall (31) of the "U" shape channel. The terraced region is protruding upwardly from the upper surface (13).

Figure 9:
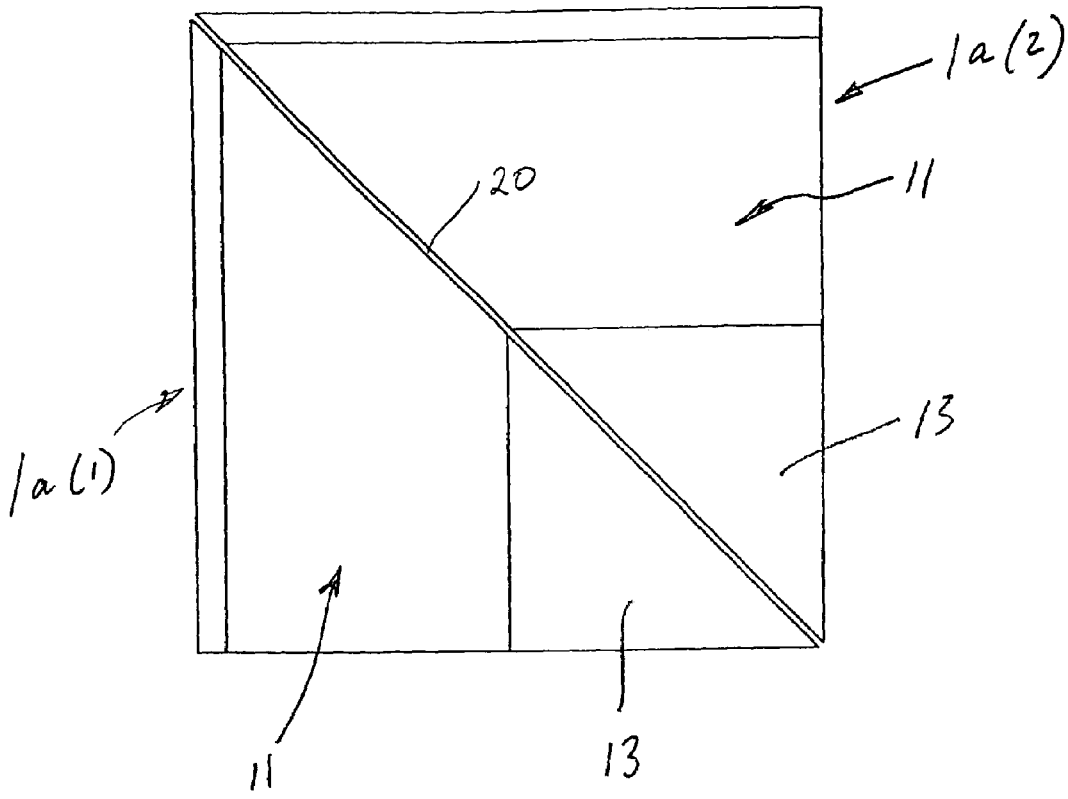
FIG. 9 shows a top view with two straight parts joined together.

The corner parts (1*b*) with an angular configuration have the same section as the straight part (1*a*). Whether they have a 90-degree angle or another value, the corner parts are shaped by what would be simply joining two straight parts (1*a*) depending on the required angle. The preferred embodiment of a corner part, shown in FIG. 9 as a top view, is the result of angle cutting two straight parts at 20 and joining them.

At the bottom of the "U" configuration (11), the drainage parts (1*c*) have a hole (14) to connect a drainage pipe (3) for the water collected in the channel.

Figure 7:
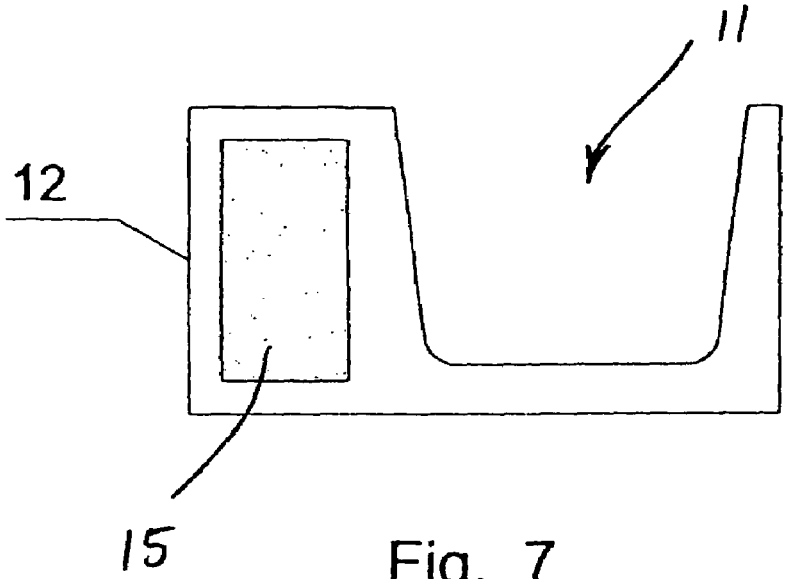
FIG. 7 shows an example of the part to place the fitted steps.
Figure 8A:
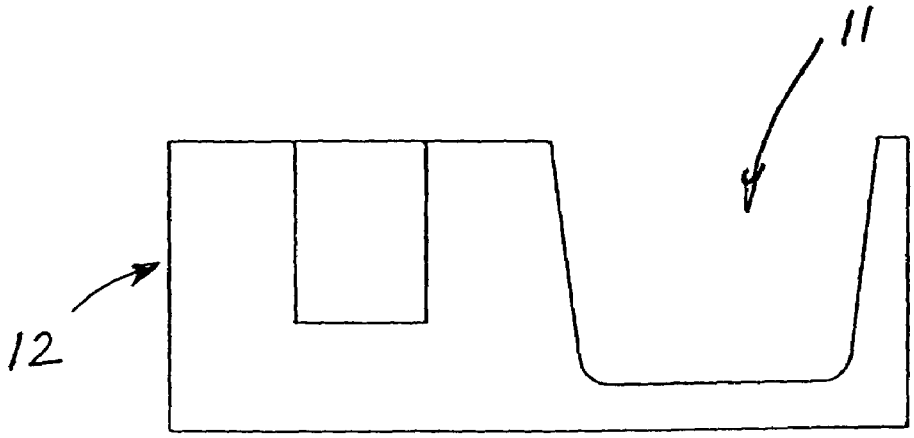
FIG. 8*a* shows a section view of a straight part that includes the hole to anchor a lane divider.
Figure 8B:
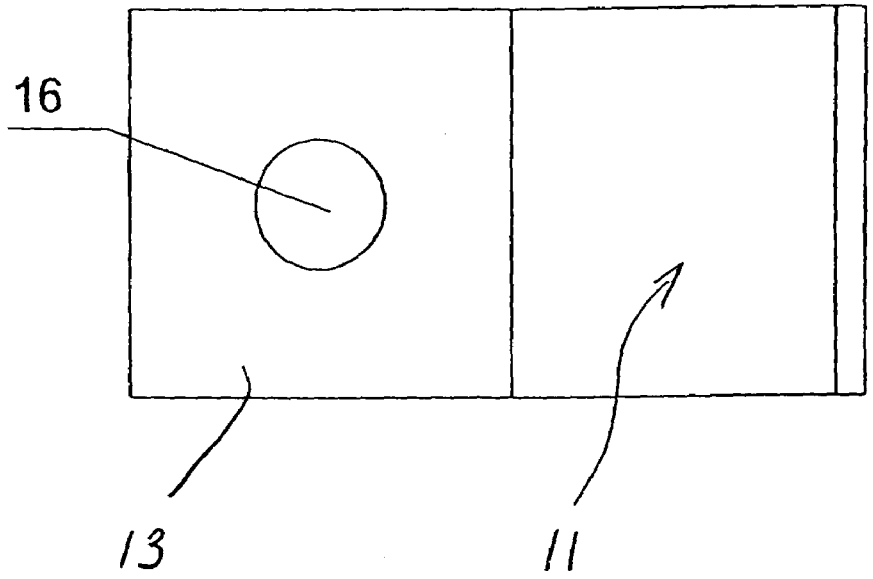
FIG. 8*b* shows a top view of the straight in FIG. 8*a*.

The parts for fitted steps have the same normal features as the straight parts, with the difference being that the side prolongation (12) is shorter, as indicated in FIG. 7.

The parts used to anchor lane dividers differ from the straight parts as the side prolongation (12) is solid with a hole (16) part way through the prolongation (12) to provide anchorage.

In order to prevent possible cracks in the join between adjacent parts (1*a*, 1*b*, 1*c*) that could cause water from entering inside the side prolongation (12) with the resulting problems such as water freezing that could break the part, the inside hollow of the prolongation (12) is typically filled with a low-density plastic material (15), such as expanded polyurethane foam.

Figure 1:
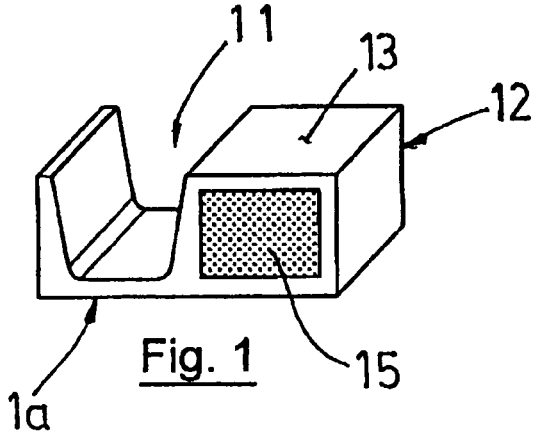
FIG. 1 shows a perspective view of a straight part.
Figure 2:
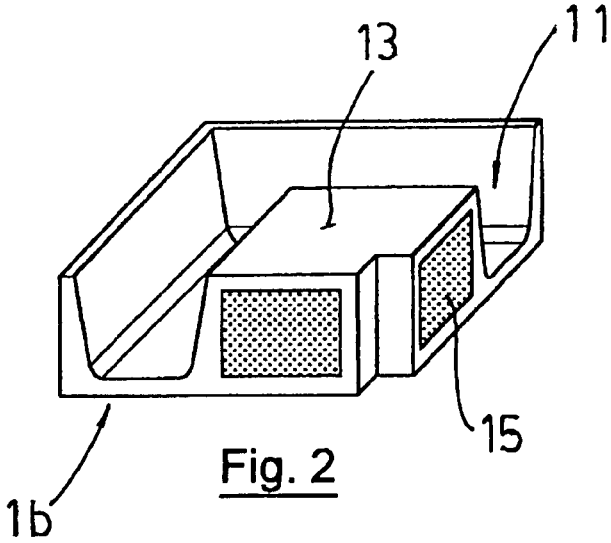
FIG. 2 shows a perspective view of a corner part.
Figure 3:
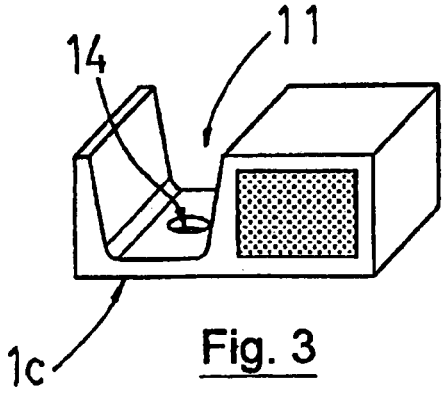
FIG. 3 shows a perspective view of a drainage part.
Figure 4:
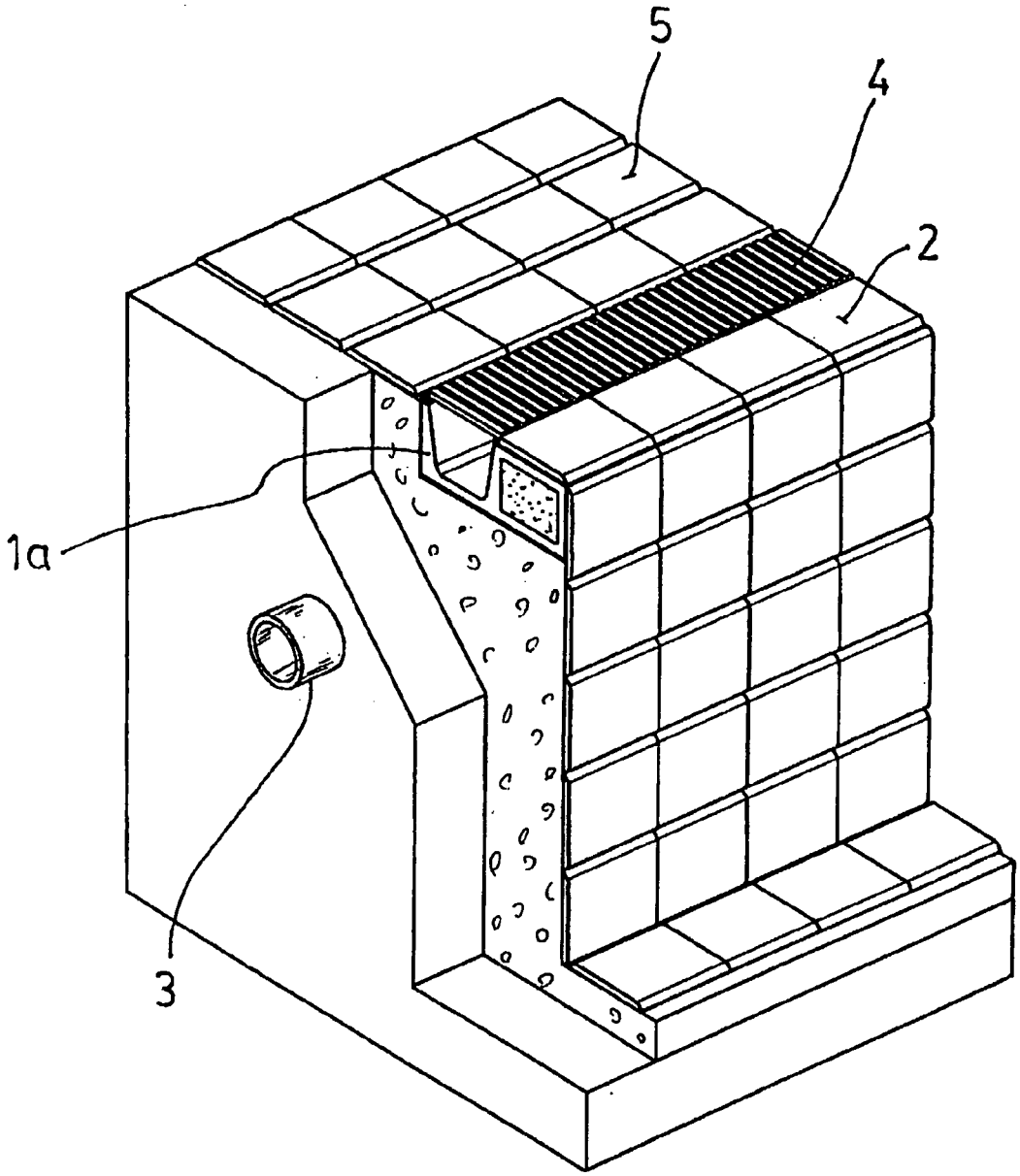
FIG. 4 shows the details of the assembly of one of the straight parts forming the perimeter channel of a swimming pool.

FIG. 4 shows one of the straight parts (1*a*) forming a length of the channel and the edge of the overflow swimming pool, the tiles (2) that finish the edge of the pool, the outer tiles (5), the grille (4) that covers the channel, and the drainage pipe (3).

The materials, shape, arrangement and layout of elements may vary as long as this does not alter the basic features of the invention, the claims of which are made below.

The invention claimed is:

1. A set of parts formed separately and assembled to build an upper edge and a channel in an overflow swimming pool wherein each part of said set of parts comprises a material having a "U" shape that forms the channel (11), said channel having an adjacent side prolongation (12) having an upper surface (13) extending from said "U" shape channel toward the interior of the overflow swimming pool, said channel and said side prolongation having a substantially coplanar lower surface (22), said upper surface (13) of said side prolongation (12) is angled between approximately 0 and 15 degrees and slanted downwardly toward the interior of the pool, and wherein said upper surface (13) forms a base to place tiles (2) that finish the edge of the swimming pool; said upper surface includes a terraced region protruding upwardly from said upper surface of said side prolongation, said terraced region formed on a first end of said upper surface that is adjacent to the inner wall of the "U" shaped channel, whereby each said part is combined with other parts of said set of parts to form the upper edge and the channel of the overflow swimming pool in a single operation.

2. Set of parts according to claim 1 wherein said parts are straight (1*a*).

3. Set of parts according to claim 2 further comprising corner parts (1*b*) formed by cutting at least two of said straight parts (1*a*) at a desired angle and joining said cut straight parts at their resulting cut edges.

4. Set of parts according to claim 2 further comprising drainage parts (1*c*) having a drainage hole (14) at the lower portion of said "U" shape channel.

5. Drainage parts (1*c*) according to claim 4 further comprising a drainage pipe to collect water from said "U" shaped channel that drains from said drainage hole (14).

6. Set of parts according to claim 2 further comprising fitted steps wherein said side prolongation is shorter than the prolongation of the straight parts (1*a*).

7. Set of parts according to claim 2 further comprising curved edge parts having curved channels.

8. Set of parts according to claim 2 further comprising lane divider anchorage parts having an anchor hole at least part of the way through said prolongation to provide an anchorage point.

9. Set of parts according to claim 1 wherein said side prolongation (12) is hollow.

10. Set of parts according to claim 9, wherein said hollow side prolongation (12) includes a plastic material (15).

11. Set of parts according to claim 10 wherein said plastic material (15) is low-density.

12. Set of parts according to claim 1 wherein said material is selected from the group consisting essentially of: ceramic, cement, stoneware, baked clay and polymer.

* * * * *